US007000584B1

(12) United States Patent
Wynveen et al.

(10) Patent No.: US 7,000,584 B1
(45) Date of Patent: Feb. 21, 2006

(54) THERMALLY INSULATED CYLINDER LINER

(75) Inventors: Steve Wynveen, Germantown, WI (US); David J. Belter, Oshkosh, WI (US); Timothy S. Reid, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/793,000

(22) Filed: Mar. 4, 2004

(51) Int. Cl.
*F02F 1/04* (2006.01)

(52) U.S. Cl. ..... 123/193.2

(58) Field of Classification Search .. 123/193.1–193.5, 123/41.68, 41.69, 41.79–41.8, 41.56–41
See application file for complete search history.

(56) References Cited

U.S. PATENT DOCUMENTS 3,641,882 A * 2/1972 Hall ..... 92/171.1
3,672,263 A * 6/1972 Mirjanic ..... 92/144
3,714,931 A * 2/1973 Neitz et al. ..... 123/41.79
4,453,527 A * 6/1984 Wade ..... 123/669
4,562,799 A * 1/1986 Woods et al. ..... 123/193.2
4,838,235 A * 6/1989 Kawamura et al. ..... 123/668
4,909,230 A * 3/1990 Kawamura ..... 123/668
4,926,801 A * 5/1990 Eisenberg et al. ..... 123/41.84
4,936,262 A * 6/1990 Paul et al. ..... 123/25 C
5,150,668 A 9/1992 Bock ..... 123/41.8
5,207,188 A * 5/1993 Hama et al. ..... 123/41.79
5,233,947 A * 8/1993 Abe et al. ..... 123/41.79
5,251,578 A 10/1993 Kawauchi et al. ..... 123/41.84
5,582,144 A 12/1996 Mizutani ..... 123/193.2
5,749,331 A * 5/1998 Pettersson et al. ..... 123/193.2
5,887,558 A * 3/1999 Kampichler et al. ..... 123/193.2
5,950,593 A * 9/1999 Matsuoka et al. ..... 123/292
6,073,605 A * 6/2000 Matsuoka et al. ..... 123/292
6,123,052 A * 9/2000 Jahn ..... 123/41.79
6,223,702 B1 * 5/2001 Achenbach et al. ..... 123/41.71
6,298,818 B1 * 10/2001 Koyama et al. ..... 123/193.2
2002/0033149 A1 3/2002 Negishi et al. ..... 123/41.83

* cited by examiner

*Primary Examiner*—Marguerite McMahon
(74) *Attorney, Agent, or Firm*—William D. Lanyi

(57) ABSTRACT

An engine is provided with a plurality of cylinders and cylinder liners that are shaped to define a plurality of spaces between the liners and the engine block. These spaces provided an insulative barrier that at least partially restricts the flow of heat from the liner into the engine block. This allows the liners to operate at elevated temperatures while avoiding a deleterious increase in the cooling water temperature as it flows through passages within the engine block.

12 Claims, 4 Drawing Sheets

THERMALLY INSULATED CYLINDER LINER

BACKGROUND OF THE INVENTION

1. Field of the Invention

The present invention relates generally to an insulated liner and, more particularly, to an insulated liner with a thermally insulative medium disposed between the liner and the cylinder wall in order to reduce the thermal conductivity between the liner and the cylinder block.

2. Description of the Prior Art

Those skilled in the art of engine design are familiar with the use of cylinder liners which are disposed within the cylinders of an engine block. Typically, the cylinder liner is made of a different material than the engine block.

U.S. Pat. No. 5,150,668, which issued to Bock on Sep. 29, 1992, describes a cylinder liner with a coolant sleeve. The liners must be adequately cooled to obviate oil degradation, carbon packing in the ring area, and piston seizure. The engine includes a block which cooperates with the cylinder liners to define an upper and lower axially spaced coolant chambers. A sleeve is located in a groove defined in the cylinder liner and disposed between the upper and lower coolant chambers. The sleeve and the cylinder liner define a plurality of circumferentially spaced venturi throats. The venturi throats provide a relative long flow path and controls the flow rate of the coolant being communicated from the lower coolant chamber to the upper coolant chamber in order to dissipate heat away from the cylinder liner.

U.S. Pat. No. 5,251,578, which issued to Kawauchi et al. on Oct. 12, 1993, describes a cooling system for an internal combustion engine. The cooling system is able to realize a cooling effect matching a distribution of incoming heat of a cylinder liner. A plurality of annular grooves is formed on an outer surface of the cylinder liner, and a passage connecting the annular grooves is also provided. An introducing passage part is formed between an inlet passage of a coolant and the uppermost annular groove. A curved portion is provided to the introducing passage part. A flow direction of the coolant flowing into the introducing passage part is smoothly changed so as to flow along a direction of a passage connecting the annular grooves. An amount of coolant flowing into the annular grooves located lower than the uppermost annular groove is increased appropriately.

U.S. Pat. No. 5,582,144, which issued to Mizutani on Dec. 10, 1996, describes a dry cylinder liner for internal combustion engines. The liner has a flange at the outer circumference of the upper part of a liner barrel, and also has a grind relief groove formed below the flange at the outer circumferential surface of the liner barrel. The upper surface and the lower surface of the flange are coated with a coating film comprising a heat resistant resin containing a solid lubricant. The coating film may also be applied to only the lower surface of the inner flange. This coating film may also be applied to the upper surface of a cylinder block that contacts the lower surface of the liner flange.

U.S. patent application Ser. No. 09/953,867, which was filed by Negishi et al. on Sep. 18, 2001, describes a cooling system for a cylinder liner. An oil groove is formed on a top deck of a cylinder block to surround a cylinder liner such that the groove does not substantially extend deeper beyond cylindrical load plane of a seal ring on a head gasket, which prevents a clamp-down load of the gasket from acting as a bending load on an upper wall of the groove. The cylinder liner, which receives a great amount of heat transmitted from a top ring on a piston when the latter is near and at its top dead center position, can be effectively cooled without deformation of the cylinder block and/or the cylinder liner even if the top ring is positioned at an elevated position for the purpose of attaining a high compression ratio.

The patents described above are hereby expressly incorporated by reference in the description of the present invention.

Many cylinder liner structures are particularly configured to provide improved cooling of the liner. However, in certain applications of internal combustion engines, it is important that the cylinder liner be allowed to increase in temperature beyond that which would normally be controlled by a cooling system. This is particularly true when the internal combustion engine is used in a marine environment and with an open cooling system that draws water from a body of water and circulates that water through the cooling passages of the engine.

It would therefore be significantly beneficial if a configuration could be provided for a cylinder liner which allowed the cylinder to achieve higher temperatures than would otherwise result from the use of cooling water in an open cooling system. It would also be beneficial if the cooling water could be maintained at a lower temperature than the desired temperature of the cylinder liners.

SUMMARY OF THE INVENTION

An internal combustion engine, made in accordance with a preferred embodiment of the present invention, comprises a cylinder formed in an engine and a generally cylindrical liner disposed within the cylinder. The cylinder and the generally cylindrical liner are shaped to define spaces therebetween, with the spaces being configured to contain a thermally insulative medium therein.

The thermally insulative medium can be air. The spaces are sealed in a particularly preferred embodiment to prevent the thermally insulative medium from escaping from the spaces.

In one embodiment of the present invention, the spaces are formed between an outer surface of the liner and a plurality of grooves formed in an inner cylindrical surface of the cylinder. Alternatively, the spaces can be formed between a plurality of grooves formed in an outer surface of the liner and an inner cylindrical surface of the cylinder. The plurality of grooves can be generally circumferential or generally axial. In a preferred embodiment of the present invention, a piston is slidably disposed within the cylinder. A plurality of such cylinders are provided within the engine block.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
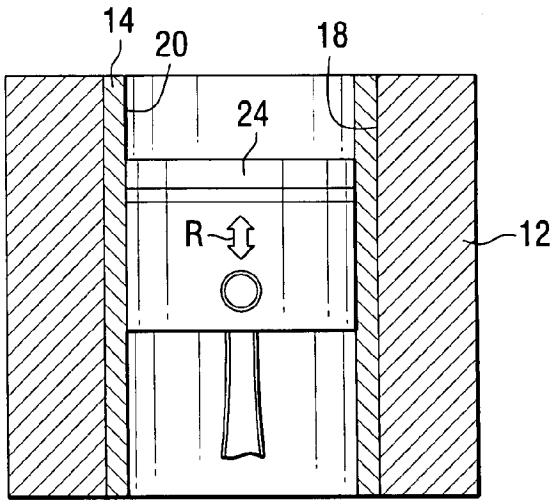
FIG. 2 PRIOR ART
FIGS. 1 and 2 illustrate prior art configurations of cylinders and liners.

Throughout the description of the preferred embodiment of the present invention, like components will be identified by like reference numerals.

Figure 1:
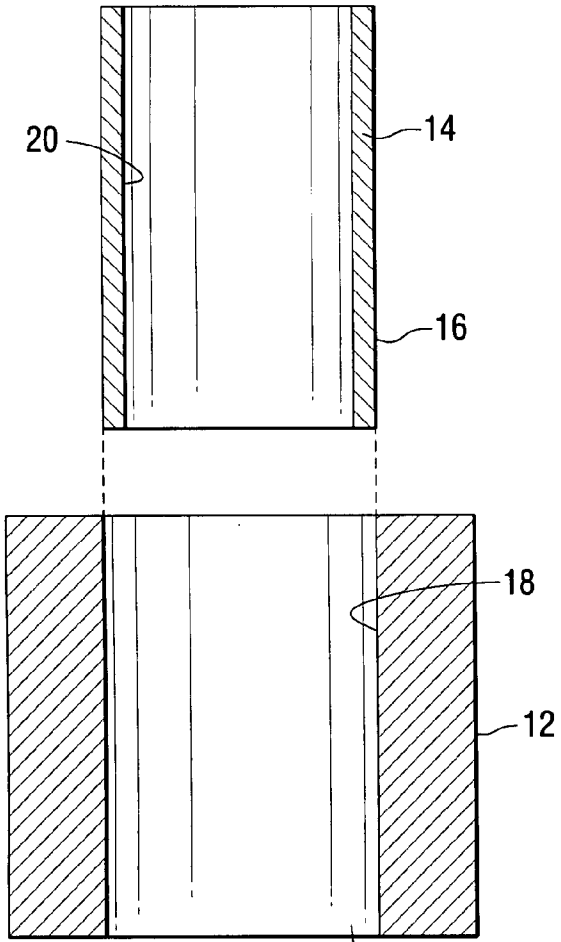
FIG. 1 PRIOR ART

In FIG. 1, a cylinder 10 is schematically illustrated within an engine block 12. A liner 14 is shown separated from the cylinder 10. The outer surface 16 of the liner 14 is shaped to be received in interfering relation with the inner cylindrical surface 18 of the cylinder 10. Typically, the liner 14 is assembled into the cylinder 10 in a heat shrink manner to provide an interference fit between the liner 14 and the cylinder 10. The inner cylindrical surface 20 of the liner 14 is shaped to receive a piston in slidable association therein.

FIG. 2 shows the liner 14 disposed in interfering relation with the inner cylindrical surface 18 of the cylinder 10. Within the liner 14, a piston 24 is disposed for reciprocal movement, as indicated by Arrow R. The basic configuration illustrated in FIGS. 1 and 2 is well known to those skilled in the art.

Although not shown in FIGS. 1 and 2, it should be understood that the engine block 12 is provided with cooling channels that conduct a coolant in thermal communication with the heat producing components of the engine. Heat flows in a direction from the inner cylindrical surface 20 of the liner 14 radially outward toward the inner cylindrical surface 18 of the engine block 12. It then flows outwardly through the engine block 12 to cooling channels that conduct a coolant in thermal communication with the block. This removes heat from the engine.

In closed cooling systems, the arrangement shown in FIGS. 1 and 2 is generally suitable for removing heat from the engine. The temperature of the coolant can be allowed to reach relatively high temperatures, such as eighty-eight degrees centigrade, because the closed cooling system uses a coolant that is continuously recirculated. In an open cooling system, such as that used in a marine propulsion system of a marine vessel, the continuous flow of water from a body of water through the cooling system can cause serious problems if the temperature of the water is allowed to exceed a predetermined maximum, such as seventy degrees centigrade. When this occurs, calcium can be precipitated out of the coolant water stream and deposited on internal walls of the cooling channels within the engine. This is significantly deleterious. As a result, if the temperature of the cylinder liners is allowed to exceed a temperature which raises the temperature of the cooling water above this calcium precipitation temperature, the calcium will be deposited on the internal surfaces of the engine. However, in certain applications of marine propulsion systems, it is desirable that the cylinder liners be operated at a temperature in excess of a temperature that would otherwise cause this deleterious result. In other words, it is sometimes advantageous to operate the cylinder liners at elevated temperatures, but those elevated temperatures could result in a heating of the cooling water above that which would deposit calcium within the cooling channels of the engine.

These problems can be solved if heat is inhibited from flowing away from the cylinder liners at a rate which would lower the cylinder liner temperature below a desired threshold while simultaneously avoiding an increase in the cooling water above a threshold which would cause calcium precipitation and deposition on the internal surfaces of the engine.

In order to achieve the seemingly conflicting goals, the present invention provides an insulative medium between the cylinder liner and the engine block. The present invention has several alternative embodiments that can achieve its fundamental goals.

Figure 3:
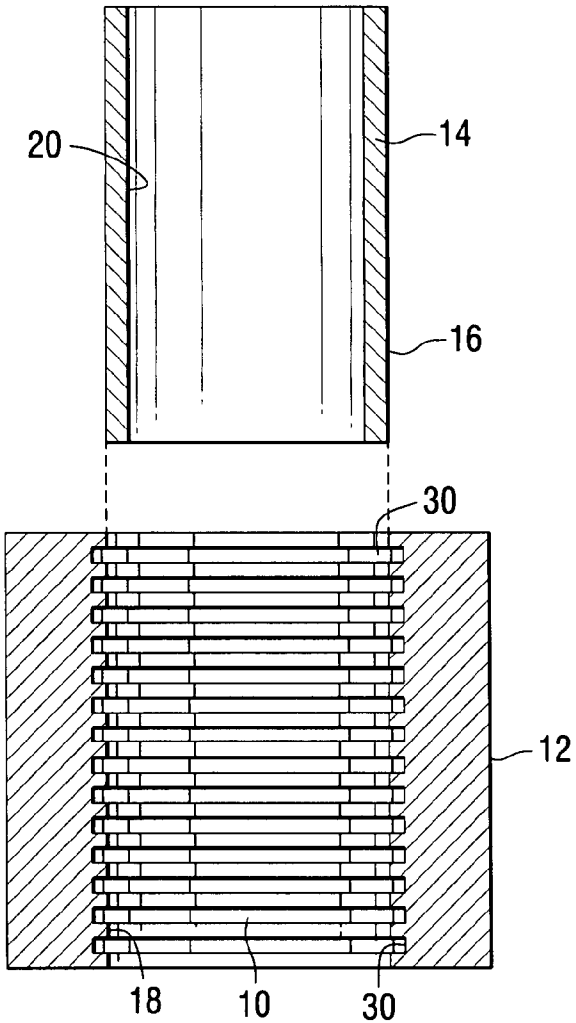

In FIG. 3, an embodiment of the present invention uses a cylinder liner 14 that is generally conventional in appearance and similar to the liner 14 described above in conjunction with FIGS. 1 and 2. The inner cylindrical surface 18, of the engine block however, is provided with a plurality of grooves 30 as shown in FIG. 3. In this particular embodiment, the grooves 30 are generally circumferential and extend around the inner cylindrical surface 18 of the cylinder 10.

Figure 4:
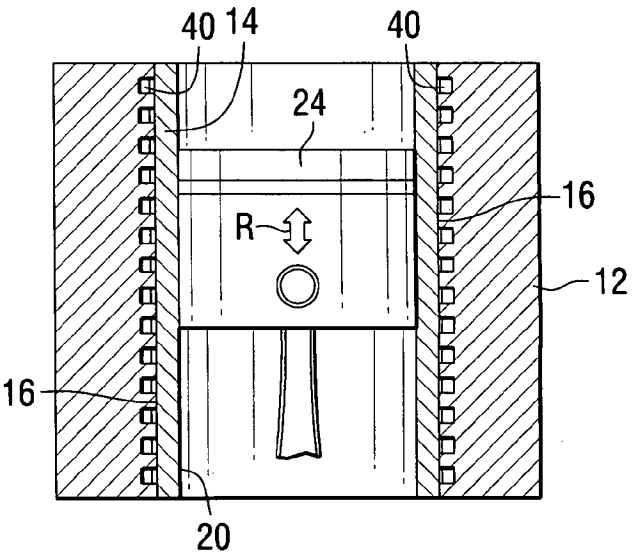
FIGS. 3 and 4 show a preferred embodiment of the present invention.

With reference to FIG. 4, it can be seen that a plurality of spaces 40 are formed when the cylinder liner 14 is disposed within the cylinder. The spaces are defined by the grooves 30 formed in the cylinder wall and the outer surface 16 of the liner 14. In FIG. 4, the spaces are generally circumferential and are sealed between the inner surfaces of the cylinder 10 and the outer surface 16 of the liner 14.

With continued reference to FIGS. 3 and 4, it should be understood that the spaces 40 provide a thermally insulative medium between the cylinder surface and the outer liner surface. The thermally insulative medium can be air or, in certain alternative embodiments, can be an additional insulator disposed within the grooves 30 and sealed within the spaces 40 that are defined by the outer surfaces of the grooves 30 and the outer surface 16 of the liner 14.

Figure 5:
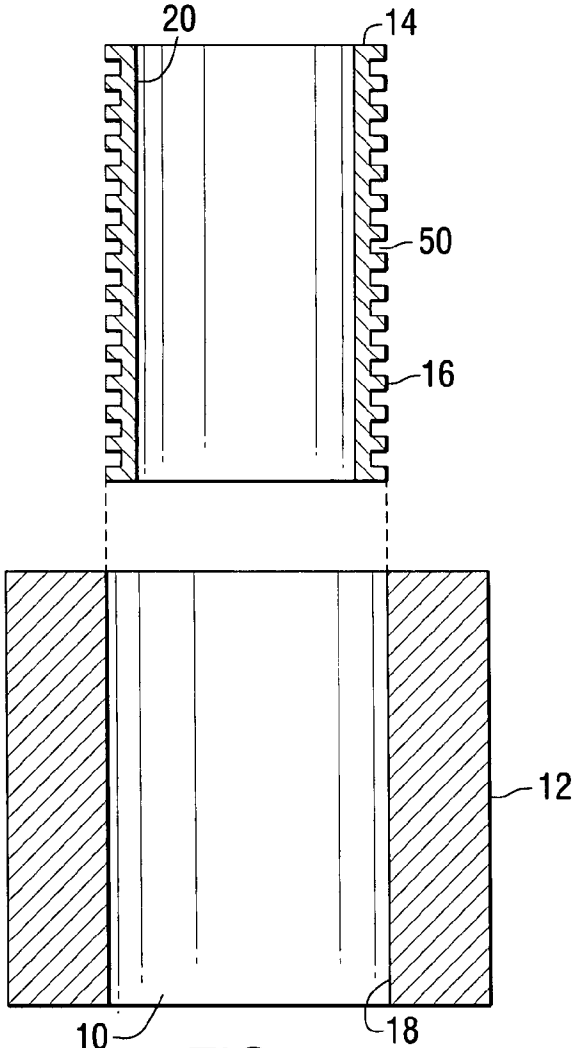

FIG. 5 shows a liner 14 that has a plurality of circumferential grooves 50 formed in its outer surface 16. The inner surface 18 of the cylinder 10 is generally smooth.

Figure 6:
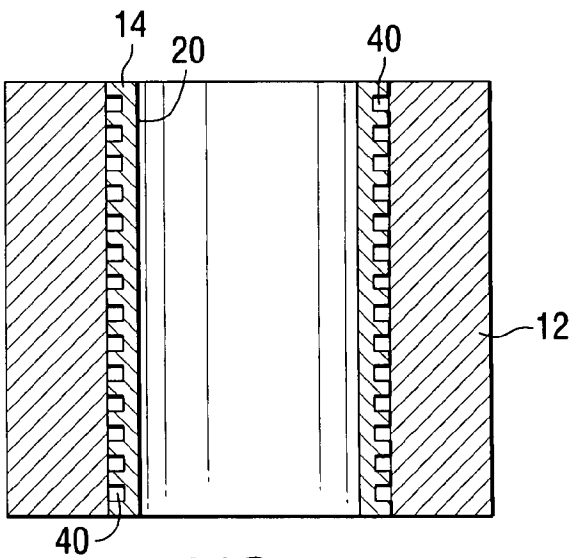
FIGS. 5 and 6 show an alternative embodiment of the present invention.

FIG. 6 shows the liner 14 disposed within the inner surface 18 of the cylinder. A plurality of spaces 40 are defined between the inner cylindrical surface 18 of the cylinder 10 and the outer surfaces of the liner 14 which are formed by the grooves 50. These spaces 40 provide a partially insulative barrier between the liner 14 and the inner cylindrical surface 18 of the cylinder 10.

Figure 8:
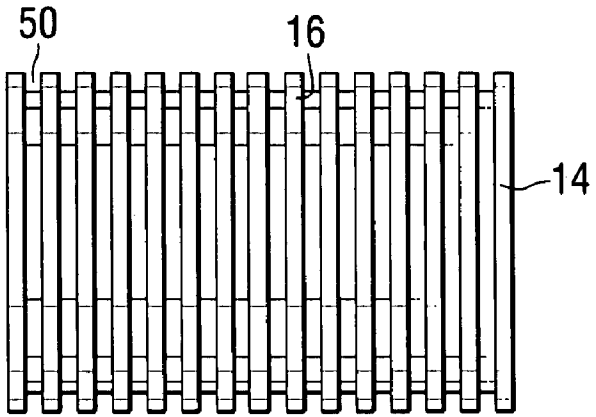
FIGS. 7 and 8 show grooves in the outer surface of a cylinder liner.
Figure 7:
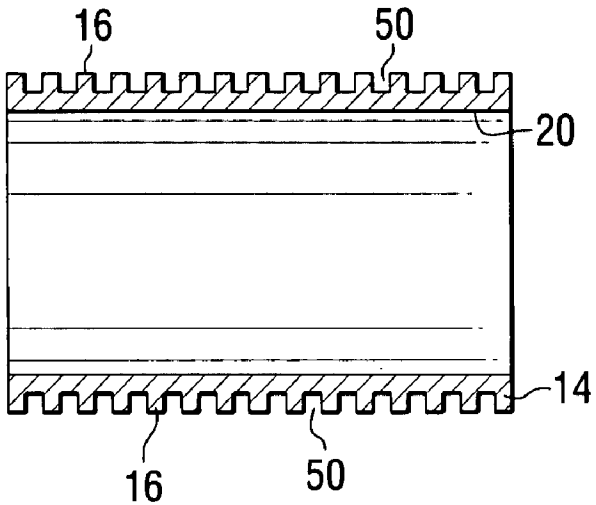

FIG. 7 is a sectional view of the liner 14 which is generally similar to that illustrated in FIG. 5. FIG. 8 shows the liner 14 that is not sectioned. The grooves 50 are formed circumferentially in the outer surface 16 of the liner 14.

Figure 9:
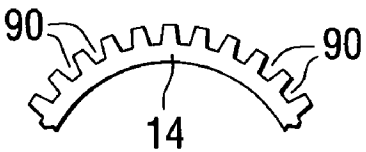
FIG. 9 is a partial section view of a cylinder liner with axial grooves formed therein.

Although the grooves have been described above, in conjunction with FIGS. 3–8 as being generally circumferential, it should be understood that the grooves could be replaced with a thread that is spirally formed in the outer surface of the liner 14 or the inner surface 18 of the cylinder 10. The important element of the present invention is that a discontinuity is provided that, when the liner and the cylinder are associated together, define one or more spaces that serve to contain a thermally insulative medium therein. In addition, although the grooves 50 have been described as generally circumferential and extending around the periphery of the outer surface of either the liner 14 or the cylinder 10, the present invention can also comprise axial grooves. FIG. 9 is a partial section view of a liner with a plurality of axial grooves 90 formed in the outer surface of the liner. The axial grooves extend in a direction generally parallel to a central axis of the liner 14.

With continued reference to FIGS. 3–9, it can be seen that an internal combustion engine made in accordance with a preferred embodiment of the present invention comprises a cylinder 10 formed in an engine block 12. A generally cylindrical liner 14 is disposed within the cylinder 10. The cylinder 10 and the generally cylindrical liner 14 are shaped to define spaces 40 therebetween. The spaces 40 are configured to contain a thermally insulative medium therein.

The thermally insulative medium can be air and the spaces 40 are sealed to prevent the thermally insulative medium from escaping.

As described above in conjunction with FIGS. 3–6, the spaces 40 can be formed between an outer surface of the liner 14 and a plurality of grooves (reference numerals 30 and 50) formed in the inner cylindrical surface 18 of the cylinder 10. The plurality of grooves can be generally circumferential or axial. As described above in conjunction with FIGS. 5 and 6, the spaces 40 can be formed between a plurality of grooves 50 formed in an outer surface 16 of the liner 14 and an inner cylindrical surface 18 of the cylinder 10. The plurality of grooves can be generally circumferential or axial. A piston 24 is typically disposed, in slidable relation, within the cylinder 10.

Although the present invention has been described in considerable detail and illustrated to show one or more preferred embodiments, it should be understood that alternative embodiments are also within its scope.

It is important to note that the primary and fundamental purpose of the present invention is to prevent heat from efficiently flowing from the liner 14 into the engine block 12. By insulating the liner from the cylinder block, the liner can be operated at elevated temperatures without having to raise the temperature of cooling water above a predetermined limit that may cause calcium to precipitate from the water and be deposited on the internal surfaces of the cooling system in the engine.

The invention claimed is:

1. An internal combustion engine, comprising:

a cylinder formed in said engine;

a generally cylindrical liner disposed within said cylinder; and said cylinder and said generally cylindrical liner being shaped to define spaces therebetween, said spaces being configured to contain a thermally insulative medium therein, said spaces being formed between an inner cylindrical surface of said cylinder and a plurality of grooves formed in an outer surface of said liner.

2. The engine of claim 1, wherein:

said thermally insulative medium is air.

3. The engine of claim 1, wherein:

said spaces are sealed to prevent said thermally insulative medium from escaping.

4. The engine of claim 1, wherein:

said plurality of grooves is generally circumferential.

5. The engine of claim 1, wherein:

said plurality of grooves is generally axial.

6. The engine of claim 1, wherein:

said plurality of grooves is generally circumferential.

7. The engine of claim 1, wherein:

said plurality of grooves is generally axial.

8. The engine of claim 1, further comprising:

a piston slidably disposed within said cylinder.

9. An internal combustion engine, comprising:

a cylinder formed in said engine;

a generally cylindrical liner disposed within said cylinder; and a thermal insulator disposed between said cylinder and said generally cylindrical liner to inhibit the flow of heat away from said generally cylindrical liner, one or more spaces being formed between an inner cylindrical surface of said cylinder and a plurality of grooves formed in an outer surface of said liner.

10. The engine of claim 9, further comprising:

a piston slidably disposed within said cylinder.

11. An internal combustion engine, comprising:

a cylinder formed in said engine;

a generally cylindrical liner disposed within said cylinder; and a thermal insulator disposed between said cylinder and said generally cylindrical liner to inhibit the flow of heat away from said generally cylindrical liner, said thermal insulator comprising one or more spaces defined by the shapes of the opposing surfaces of said cylinder and said generally circular liner, said one or more spaces being configured to contain a thermally insulative medium therein, said one or more spaces being formed between an inner cylindrical surface of said cylinder and a plurality of grooves formed in an outer surface of said liner.

12. The engine of claim 11, wherein:

said thermally insulative medium is air, said one or more spaces being sealed to prevent said thermally insulative medium from escaping.

* * * * *